US010143288B2

(12) United States Patent
Sakuma et al.

(10) Patent No.: US 10,143,288 B2
(45) Date of Patent: Dec. 4, 2018

(54) COSMETIC APPLICATOR

(71) Applicant: Mitsubishi Pencil Company, Limited, Tokyo (JP)

(72) Inventors: Satoshi Sakuma, Fujioka (JP); Takayuki Hayakawa, Fujioka (JP); Shigeki Ooba, Fujioka (JP)

(73) Assignee: MITSUBISHI PENCIL COMPANY, LIMITED, Shinagawa-ku, Tokyo (JP)

( * ) Notice: Subject to any disclaimer, the term of this patent is extended or adjusted under 35 U.S.C. 154(b) by 0 days.

(21) Appl. No.: 15/096,847

(22) Filed: Apr. 12, 2016

(65) Prior Publication Data

US 2016/0295990 A1 Oct. 13, 2016

(30) Foreign Application Priority Data

Apr. 13, 2015 (JP) ..... 2015-082089

(51) Int. Cl.

| | |
|---|---|
| ***A45D 34/04*** | (2006.01) |
| ***B43K 7/06*** | (2006.01) |
| ***B43K 5/12*** | (2006.01) |

(52) U.S. Cl.

CPC ..... *A45D 34/042* (2013.01); *A45D 34/041* (2013.01); *B43K 5/12* (2013.01); *B43K 7/06* (2013.01)

(58) Field of Classification Search

CPC combination set(s) only.
See application file for complete search history.

(56) References Cited

U.S. PATENT DOCUMENTS 3,424,537 A * 1/1969 Henriksen ..... B43K 7/035 401/101
5,073,058 A 12/1991 Fukuoka et al.
5,709,493 A * 1/1998 Kobayashi ..... B43K 5/1881 401/141

(Continued)

FOREIGN PATENT DOCUMENTS

EP 1 462 495 A1 9/2004
JP 1993-007822 A 1/1993

(Continued)

OTHER PUBLICATIONS

Search Report dated Feb. 8, 2018, by the French National Industrial Property Institute in corresponding French Patent Application No. 1653191. (2 pages).

*Primary Examiner* — David Walczak
(74) *Attorney, Agent, or Firm* — Buchanan, Ingersoll & Rooney PC

(57) ABSTRACT

Provided is a cosmetic applicator which is excellent in a stability of discharging a liquid cosmetic and excellent as well in an aging stability of a liquid cosmetic and which makes it easy to observe the end of consuming the liquid cosmetic regardless of whether or not an inside of a reservoir is visible and whether or not a coating part is a ballpoint pen type. The cosmetic applicator is prepared by providing a cylindrical reservoir, a coating part mounted at a tip of the cylindrical reservoir, a liquid cosmetic and a liquid follower which is brought into contact with the liquid cosmetic and moves following a reduction in the liquid cosmetic and which has a hue different from that of the liquid cosmetic, wherein a volume of the follower is 0.5 or more based on a volume of the liquid cosmetic.

10 Claims, 3 Drawing Sheets

(56) References Cited

U.S. PATENT DOCUMENTS

| | | | | |
|---|---|---|---|---|
| 6,068,422 | A * | 5/2000 | Smith | B43K 5/12 401/141 |
| 6,267,523 | B1 * | 7/2001 | Poels | B43K 7/02 401/141 |
| 6,554,521 | B1 | 4/2003 | Kobayashi | |

FOREIGN PATENT DOCUMENTS

| | | | |
|---|---|---|---|
| JP | 2001-340131 | A | 12/2001 |
| JP | 2007-000272 | A | 1/2007 |

* cited by examiner

COSMETIC APPLICATOR

This nonprovisional application claims priority under 35 U.S.C. § 119(a) on Patent Application No. 2015-082089 filed in Japan on 13 Apr. 2015, the entire contents of which are hereby incorporated by reference.

BACKGROUND OF THE INVENTION (1) Field of the Invention

The present invention relates to a cosmetic applicator which is excellent in a stability of discharging a liquid cosmetic and excellent as well in a stability of a liquid cosmetic with the passage of time and which makes it easy to observe the end of consuming the liquid cosmetic regardless of whether or not an inside of a reservoir is visible and whether or not a coating part is a ballpoint pen type.

(2) Description of Related Art

A device for redispersing the pigment has so far been indispensable in an applicator in which a cosmetic having a low viscosity and containing a pigment is filled and held. That is, it is a device in which a stirrer such as a stirring ball, a stirring rod and the like is charged into a reservoir of a cosmetic, wherein the whole applicator is shaken until the stirrer sounds sufficiently moving around when a pigment contained therein is concerned to settle down after it is not used for a long period of time, whereby the pigment can be redispersed (refer to, for example, JP-A 1993-7822 (claims, examples, FIG. 1 and the like)).

Also, the tip of the above applicator is provided with a coating tip of a so-called ballpoint pen type in which a ball is continued to be pressed forward in a ball holder, and it is structured so that when this pressing is released, a liquid cosmetic filled in a reservoir comes out by replacing with air. The problems that a cosmetic oozes out from the tip of the applicator when the cosmetic has a low viscosity and that such a large amount of the cosmetic as unintended comes out when pressing is released are involved in the above system.

Disclosed by the present applicant isn applicator of a mechanism in which in place of the mechanism of discharging the cosmetic by replacing with air in the applicator described above, provided are a ballpoint pen tip comprising a ball and a ball holder at the tip of a cylindrical reservoir, a cosmetic and a stirrer in a reservoir, and a liquid follower at the rear of the cosmetic, wherein a space formed by the cosmetic oozed is supplemented by movement of the follower (refer to, for example, JP-A 2007-272 (claims, examples, FIG. 1 and the like)). In the applicator of the above mechanism, it is likely that the stirring ball sinks into the soft follower when shaken, and therefore a stopping member is provided between the cosmetic and the follower to prevent the stirring ball from sinking thereinto.

Further, an applicator in which a cosmetic itself is gelatinized (provided with s structural viscosity) without installing a stirrer to make stirring unnecessary and in which a follower is provided to set up a mechanism close to a so-called gel ink ballpoint pen (refer to, for example, JP-A 2001-340131 (claims, examples, FIG. 1 and the like)). In the applicator of the above mechanism, a float (following auxiliary member) is inserted from a rear of the follower in order to endure a falling impact when the applicator falls with a back turning downward, but involved therein is the problem that when an accident in which the float is brought into contact with the wall surface of the cylindrical reservoir is brought about, air is allowed to get in to cause a concern on an aging stability of the cosmetic.

SUMMARY OF THE INVENTION

An object of the present invention is to provide a cosmetic applicator which solves such the problems on the conventional technologies as described above, which is excellent in a stability of discharging a liquid cosmetic and excellent as well in an aging stability of a liquid cosmetic while inheriting the excellent matters of the conventional technologies and which makes it easy to observe the end of use regardless of whether or not a reservoir is visible and whether or not a coating part is a ballpoint pen type.

Intense investigations repeated by the present inventors have resulted in finding that a cosmetic applicator which meets the object described above is obtained by providing a cylindrical reservoir, a coating part mounted at a tip of the above cylindrical reservoir, a liquid cosmetic charged directly to the above coating part or directly to the above cylindrical reservoir communicating with the coating part via an interposed member, and a follower which is brought into contact with the above liquid cosmetic and moves following a reduction in the above liquid cosmetic due to consumption thereof and which has specific physical properties different from a hue of the above liquid cosmetic. Thus, they have come to complete the present invention.

That is, the present invention resides in the following items (1) to (11).

(1) A cosmetic applicator prepared by providing a cylindrical reservoir, a coating part mounted at a tip of the cylindrical reservoir, a liquid cosmetic charged directly to the coating part or directly to the cylindrical reservoir communicating with the coating part via an interposed member, and a liquid follower which is brought into contact with the liquid cosmetic and moves following a reduction in the liquid cosmetic due to consumption thereof and which has a hue different from that of the liquid cosmetic, wherein a volume of the follower is 0.5 or more based on a volume of the liquid cosmetic.

(2) The cosmetic applicator as described in the above item (1), wherein the liquid follower comprises at least one selected from a liquid which is insoluble or scarcely soluble in the liquid cosmetic, and a gelled substance of the liquid.

(3) The cosmetic applicator as described in the above item (2), wherein the insoluble or scarcely soluble liquid comprises a nonvolatile or scarcely volatile organic solvent, and the gelled substance of the insoluble or scarcely soluble liquid comprises a liquid containing the nonvolatile or scarcely volatile organic solvent and a thickener.

(4) The cosmetic applicator as described in the above item (3), wherein the nonvolatile or scarcely volatile organic solvent is at least one selected from polybutene, mineral oils, silicone oils, liquid paraffins, and poly-α-olefins.

(5) The cosmetic applicator as described in the above item (3), wherein the thickener is at least one selected from styrene base thermoplastic elastomers, vinyl chloride base thermoplastic elastomers, olefin base thermoplastic elastomers, polyamide base thermoplastic elastomers, polyester base thermoplastic elastomers, polyurethane base thermoplastic elastomers, calcium salts of phosphoric acid esters, fine particle silica, and acetoalkoxyaluminum dialkylates.

(6) The cosmetic applicator as described in the above item (2), wherein the follower has a specific gravity of less than 100% based on a specific gravity of the liquid cosmetic.

(7) The cosmetic applicator as described in any one of the above items (1) to (6), wherein the cylindrical reservoir is formed by a material having a light transmittance of 50% or more.

(8) The cosmetic applicator as described in the above item (1), wherein the coating part is a ball holder which holds a ball.

(9) The cosmetic applicator as described in the above item (8), wherein the ball holder is constituted by metal.

(10) The cosmetic applicator as described in the above item (1), wherein the coating part is a fiber bundle feed.

(11) The cosmetic applicator as described in the above item (1), wherein the coating part is a sintered feed.

According to the present invention, provided is a cosmetic applicator which is excellent in a stability of discharging a liquid cosmetic and excellent as well in a stability of a liquid cosmetic with the passage of time and which makes it easy to observe the end of use regardless of whether or not a reservoir is visible and whether or not a coating part is a ballpoint pen type.

BRIEF DESCRIPTION OF THE DRAWINGS

FIG. 1*a* and FIG. 1*b* show one example of the embodiment of the cosmetic applicator of the present invention, wherein FIG. 1*a* is a front view, and FIG. 1*b* is a vertical cross section.

FIG. 2*a* and FIG. 2*b* show a state in which the cap of the cosmetic applicator shown in FIG. 1*a* and FIG. 1*b* is detached, wherein FIG. 2*a* is a front view, and FIG. 2*b* is a vertical cross section.

FIG. 3*a* and FIG. 3*b* show another example of the embodiment of the cosmetic applicator of the present invention, wherein FIG. 3*a* is a vertical cross section in closing a valve, and FIG. 3*b* is a vertical cross section in opening the valve.

DETAILED DESCRIPTION OF THE INVENTION

Figure 1A:
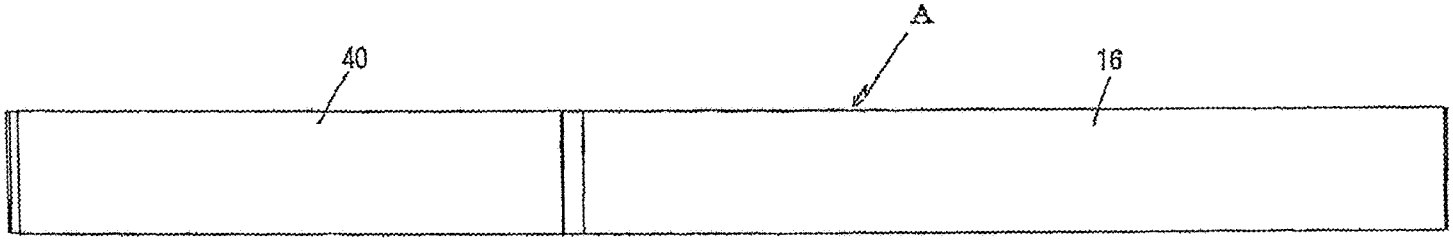
Figure 1B:
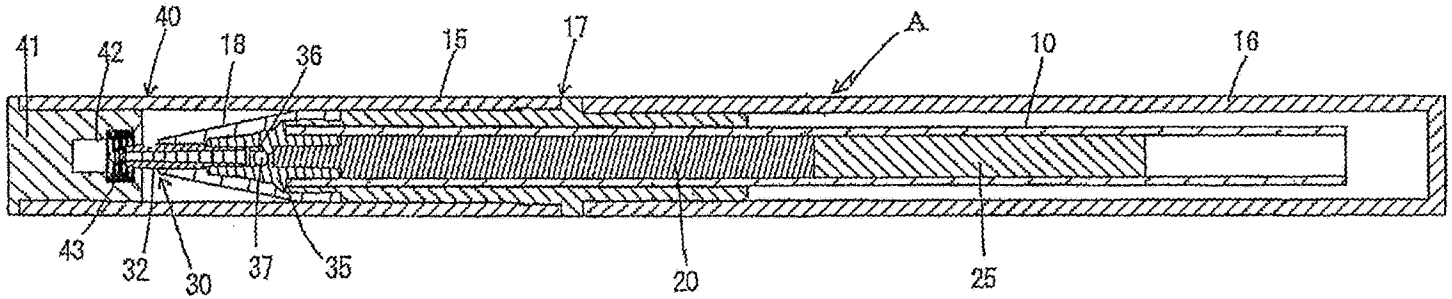
Figure 2A:
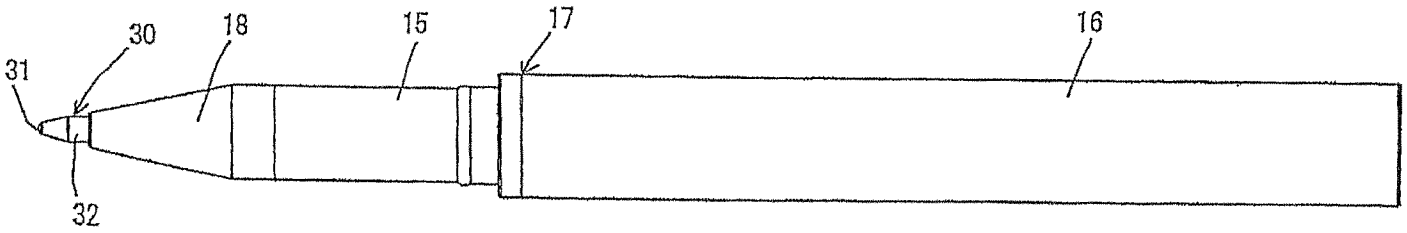
Figure 2B:
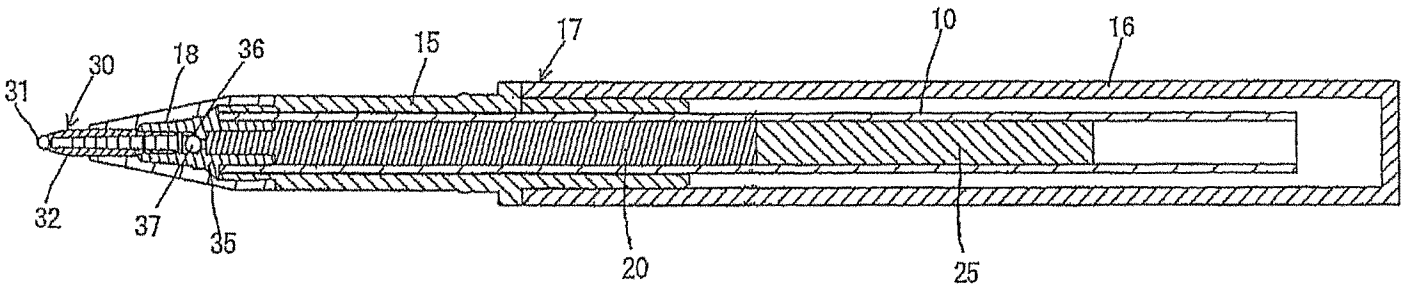

The embodiments of the present invention shall be explained below in detail with reference to the drawings.

FIG. 1*a*, FIG. 1*b*, FIG. 2*a* and FIG. 2*b* are drawings showing one example of the embodiment of the cosmetic applicator of the present invention.

The cosmetic applicator A of the present embodiment is equipped, as shown in FIG. 1*a*, FIG. 1*b*, FIG. 2*a* and FIG. 2*b*, with a cylindrical reservoir 10 of a refill type into which a liquid cosmetic 20 described later is directly filled, and a coating part 30 constituted from a ball holder which holds a ball is mounted at the tip of the above cylindrical reservoir 10.

The above cosmetic applicator A is structured so that the cylindrical reservoir 10 of a refill type is received in a barrel 17 by the barrel 17 and a lopla front holder 18 screwed at the tip of a barrel 17, wherein the barrel 17 is constituted by a cylindrical front shaft 15 which is opened at front and rear sides, and a bottomed cylindrical rear shaft 16 by a fixing means such as screwing, pressing and the like. In the present embodiment, the front holder 18 is not necessarily required and may be a part integrated with the front shaft 15. A vent hole communicating with an inside of the barrel 17 is drilled in a suited position of the barrel 17, or a vent hole or a vent groove is provided by setting up a groove in a screwing part in which the front holder 18 is fixed. A vent hole (not illustrated) communicating with an inside of the barrel can be provided as well at a rear end of the rear shaft 16 constituting the barrel 17. A fixing method of the front holder 18 shall not necessarily be restricted to screwing, and it may be fixed by pressing and the like. Also, the number 40 is a cap which is attachable by screwing with the front shaft 15.

The barrel 17 constituted from the cylindrical reservoir 10 of a refill type, the front shaft 15 and the bottomed cylindrical rear shaft 16 each described above is constituted from, for example, metal such as aluminum, stainless steel and the like, a synthetic resin, glass, and the like, and it is formed preferably by integral molding using resin materials such as polypropylene, polyvinyl alcohol, ethylene.vinyl alcohol copolymer resins (EVOH), polyacrylonitrile, nylon, cellophane, polyethylene terephthalate, polycarbonate, polystyrene, polyvinylidene chloride, polyvinyl chloride, and the like.

The barrel 17 constituted from the cylindrical reservoir 10, the front shaft 15 and the bottomed cylindrical rear shaft 16 each described above is formed more preferably by a material having a light transmittance of 50% or more, and a material having a light transmittance of 80% or more is particularly preferred in order to make it further easier to find (visible) the end of consuming the liquid cosmetic. In the present invention, the term "light transmittance" means a visible light transmittance.

Also, an inner wall surface of the cylindrical reservoir 10 described above, that is, a wall surface which is brought into contact with the liquid cosmetic may be subjected to a water repellent film forming treatment by coating with a water repellent agent of a silicone base, a silicon resin or a fluorine base. A surface free energy of the inner wall surface can be controlled to a lower level than that of the liquid cosmetic by subjecting the wall surface which is brought into contact with the liquid cosmetic to a water repellent film forming treatment, whereby a water repellency and a discharging property of the liquid cosmetic are enhanced, and the cosmetic applicator can be set so that the end of consuming the liquid cosmetic is more easily judged.

The liquid cosmetic 20 stored in the reservoir 10 shall not specifically be restricted and includes a manicure composition (nail liquid), an eyeshadow liquid, an eyebrow liquid, a cosmetic liquid for coloring skin, a liquid hair dye, an eyeliner liquid, a cosmetic liquid for lip, and the like. A viscosity of the liquid cosmetic 20 is varied according to the kind thereof, and it is suitably 500 to 3000 (m·Pa·s) according to measurement by means of a cone plate type viscometer at a measuring temperature of 25° C.

In the present embodiment, a manicure composition (nail liquid, white color) is stored as the liquid cosmetic 20 in the reservoir 10.

A liquid follower 25 which is brought into tight contact with the inner wall surface of the reservoir 10 and brought into contact with the liquid cosmetic 20 and which moves following a reduction in the liquid cosmetic 20 due to consumption thereof and has a hue different from that of the above liquid cosmetic 20 is provided at a rear end part of the liquid cosmetic 20 described above.

The above liquid follower 25 is constituted preferably from at least one selected from a liquid which is insoluble or scarcely soluble in the liquid cosmetic 20 described above, and a gelled substance of the above liquid from the viewpoint of maintaining the quality of the liquid cosmetic 20 to a high degree without damaging the function thereof.

The insoluble or scarcely soluble liquid described above preferably comprises, for example, a nonvolatile or scarcely volatile organic solvent, and the gelled substance of the insoluble or scarcely soluble liquid is constituted preferably from a liquid containing the nonvolatile or scarcely volatile organic solvent and a thickener.

At least one kind (one kind or two or more kinds; hereinafter the same shall apply) selected from, for example, polybutene, mineral oils, silicone oils, liquid paraffins, and poly-α-olefins can be used as the nonvolatile or scarcely volatile organic solvent described above which can be used.

The thickener used may be any compound as long as it is dissolved or swollen in the nonvolatile or scarcely volatile organic solvent described above and can turn the insoluble or scarcely soluble liquid into a gelled substance. It includes, for example, at least one selected from styrene base thermoplastic elastomers, vinyl chloride base thermoplastic elastomers, olefin base thermoplastic elastomers, polyamide base thermoplastic elastomers, polyester base thermoplastic elastomers, polyurethane base thermoplastic elastomers, calcium salts of phosphoric acid esters, fine particle silica, and acetoalkoxyaluminum dialkylates.

In the liquid follower 25 comprising the gelled substance containing the nonvolatile or scarcely volatile organic solvent and the thickener, the nonvolatile or scarcely volatile organic solvent accounts for 70 to 99.8% by mass, preferably 85 to 99.5% by mass and more preferably 87 to 99.5% by mass based on the whole amount of the liquid follower, and the thickener accounts for 0.2 to 30% by mass, preferably 0.5 to 15% by mass and more preferably 0.5 to 10% based on the whole amount of the liquid follower.

The liquid follower 25 described above has a specific gravity of preferably less than 100%, particularly preferably 80 to 30% based on a specific gravity of the liquid cosmetic from the viewpoint of allowing the follower to efficiently follow.

In the present invention, the liquid follower 25 is varied in a specific gravity according to the kind and the concentration of the liquid cosmetic used. For example, when a manicure composition (nail liquid) used as the liquid cosmetic 20 has a specific gravity of 1.2, the liquid follower 25 comprising the liquid of the insoluble or scarcely soluble liquid, or the liquid follower 25 comprising the gelled substance of the above liquid is controlled to a specific gravity of preferably less than 100% (specific gravity: 1.2), more preferably 80 to 30% (0.96 to 0.36).

In the present invention, the liquid follower 25 is varied in a specific gravity thereof according to the uses and the blend kind thereof, and therefore the liquid follower 25 having a specific gravity falling in the preferred ranges described above can be prepared by combining the kind of the insoluble or scarcely soluble liquid described above and a use amount thereof, the kind of the thickener and a use amount thereof, and a production method thereof.

In the present invention, the liquid follower 25 constituted in the manner described above has a volume (volume ratio thereof) of 0.5 or more, preferably 0.5 to 3 based on a volume of the liquid cosmetic from the viewpoint of a good followability and an impact resistance in falling.

The liquid follower 25 constituted in the manner described above has a hue different from that of the liquid cosmetic 20 from the viewpoint of definitely distinguishing it from the liquid cosmetic 20, and given is, for example, a case in which the liquid follower 25 is colorless when the liquid cosmetic 20 is colored and in which the liquid follower 25 is colored when the liquid cosmetic 20 is colorless. In the present embodiment, the liquid follower 25 is constituted (color: transparent) from liquid paraffin and an olefin base thermoplastic elastomer and has a volume of 0.63 based on a volume of the liquid cosmetic described above.

In the cosmetic applicator A of the present embodiment, the front holder 18 described above assumes a conical form which is formed by metal and opened at front and rear sides, and circular step parts are formed on an inner peripheral surface in smaller diameters toward the front side.

The coating part 30 is equipped with a ballpoint pen tip 32 of a metal pipe type (needle type) having a coating ball 31 at a tip, wherein a front end side thereof is pressed and fixed in the front holder 18, and a rear end side thereof is pressed and fixed in a joint member 35 discharging the liquid cosmetic stored in the reservoir 10 to the ballpoint pen tip 32 of the coating part 30.

The joint member 35 is provided in an inside thereof with a valve chest 36, and a ball valve 37 is mounted in the valve chest 36, wherein in a coating state in which the ballpoint pen tip 32 is turned downward, the ball valve 37 is brought into contact with a front side of the joint member 35, and a space is formed at a rear end part of the joint member 35 to allow the liquid cosmetic to flow into the ballpoint pen tip 32. Also, in a state in which the ballpoint pen tip 32 is turned upward, the ball valve 37 is brought into contact with a rear end side which is a ball receiving side of the joint member 35 to tightly close the flow passage of the liquid cosmetic, and therefore the liquid cosmetic does not move to a rear side of the refill even when coated with the ballpoint pen tip 32 turned upward, so that the above structure prevents the liquid cosmetic from flowing backward. Also, a sealing part 41 is fixed to the cap 40 described above, and a sealing stopper 43 for sealing the tip of the coating ball 31 is provided in a concave part 42 of the sealing part 41.

In the cosmetic applicator A of the present embodiment, an outside air is introduced through a vent hole (not illustrated) provided in a prescribed position of the barrel 17 when the liquid follower 25 moves, and therefore the liquid follower 25 follows smoothly the consumption of the liquid cosmetic 20 without restricting the movement of the liquid follower 25 due to a reduction in an internal pressure of a space part in an inside of the reservoir 10. Accordingly, the liquid cosmetic 20 is smoothly discharged from the coating ball 31 of the coating part 30, and in addition thereto, a rear end side of the liquid cosmetic 20 is structured so as to be sealed by the liquid follower 25, so that a constitution in which the liquid cosmetic 20 is excellent in an aging stability is given.

In the cosmetic applicator A of the present embodiment constituted in such the manner as described above, provided are the cylindrical reservoir 10, the coating part 30 mounted at a tip of the above cylindrical reservoir 10, the liquid cosmetic 10 charged directly to the cylindrical reservoir 10 communicating with the coating part 10 via the joint member 35 having the ball valve 37 which is an interposed member, and the liquid follower 25 which is brought into contact with the above liquid cosmetic 20 and moves following a reduction in the liquid cosmetic 20 due to consumption thereof and which has a hue different from that of the liquid cosmetic 20, wherein a volume of the follower is 0.5 or more based on a volume of the liquid cosmetic. The above constitution leads to providing the cosmetic applicator which is excellent in a stability of discharging the liquid cosmetic 20 and excellent as well in an aging stability of the liquid cosmetic 20 and which is excellent in a visibility of the reservoir 10 and the barrel 17 and therefore further excellent in a visibility thereof by controlling a light transmittance thereof to 80% or more, so that the end of consuming the liquid cosmetic 20 is more easily distinguished.

Figure 3A:
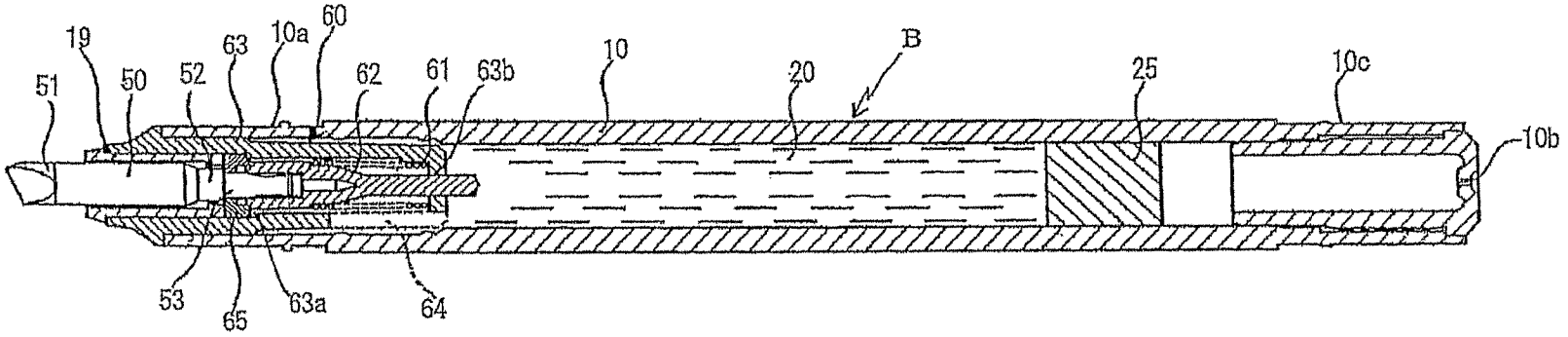
Figure 3B:
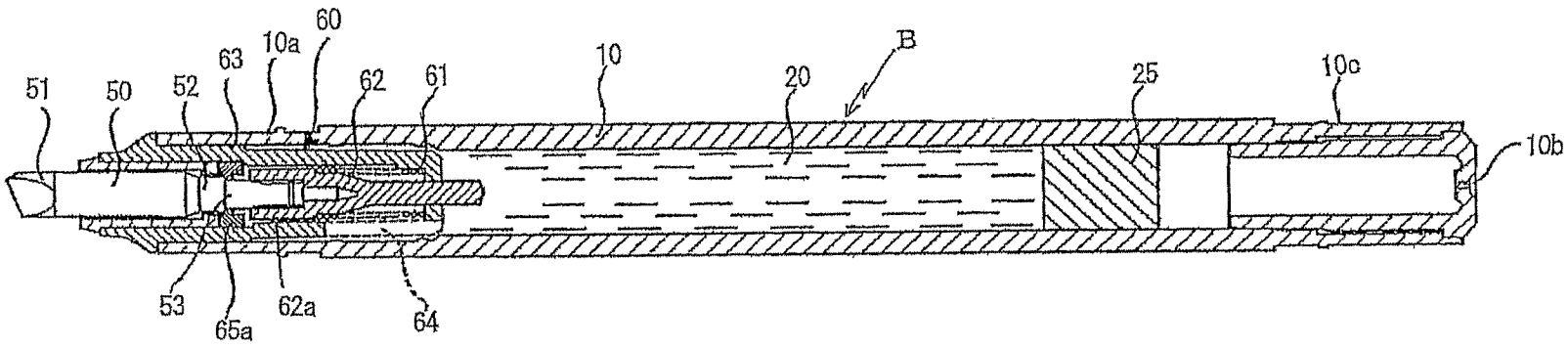

FIG. 3*a* and FIG. 3*b* are a drawing showing another example of the embodiment of the cosmetic applicator of the present invention, wherein FIG. 3*a* is a vertical cross section in closing a valve, and FIG. 3*b* is a vertical cross section in opening the valve. Parts and the like which are constituted in the same manner as the embodiment described above are shown by the same marks, and explanations therefor shall be omitted.

The cosmetic applicator B of the present embodiment is equipped, as shown in FIG. 3*a* and FIG. 3*b*, with a cylindrical reservoir 10 constituted in the same manner as the embodiment described above which is a barrel (shaft body) grasped by the user and in which a liquid cosmetic 20 constituted in the same manner as the embodiment described above is directly charged.

A coating part 50 is mounted at a tip of the cylindrical reservoir 10 described above. In the present embodiment, the coating part 50 of a pen feed form in which a front part 51 is projected from a tip part 10*a* of the cylindrical reservoir 10 is mounted, and a valve mechanism part 60 as an interposed member in which a valve is closed by pressing of a resilient member 61 comprising a coil spring in applying no force to the coating part 50 and in which the valve is opened in applying the force to introduce the liquid cosmetic 20 stored in the cylindrical reservoir 10 into the coating part 50 is provided at the rear of the coating part 50.

A liquid follower 25 constituted in the same manner as the embodiment described above which is brought into tight contact with an inner wall surface of the reservoir 10 and brought into contact with the liquid cosmetic 20 and which moves following a reduction in the liquid cosmetic 20 due to consumption thereof and has a hue different from that of the above liquid cosmetic 20 is provided at a rear end part of the liquid cosmetic 20 described above.

In the cosmetic applicator B of the present embodiment, a rear end part of the reservoir 10 is plugged by a tail valve 10*c* in which a vent hole 10*b* is formed, and an outside air is introduced through the vent hole 106 when the liquid follower 25 moves, so that the liquid follower 25 follows smoothly the consumption of the liquid cosmetic 20 without restricting the movement of the liquid follower 25 due to a reduction in an internal pressure of a space part in an inside of the reservoir 10.

A hollow cylindrical guide member 19 named so-called kutipura which slidably guides the coating part 50 is provided at a tip part 10*a* in front of the valve mechanism part 60 of the reservoir 10.

The valve mechanism part 60 has a cylindrical support member 63 in which the guide member 19 described above is fitted into an inside at a front side and in which a valve rod 62 and the resilient member 61 repelling the valve rod 62 toward the front are housed at the rear of the guide member 19, and a communication hole 64 allowing the reservoir 10 to communicate with the valve body is formed at a rear end part of the above cylindrical support member 63.

The coating part 50 is a molded feed made of a resin or a fiber, a fiber bundle feed, or a sintered feed prepared by sintering a resin or a fiber. POM, PP, nylon, PE and the like are preferred as the resin, and PET, acryl, nylon, wool and the like are preferred as the fiber or the fiber bundle. The coating part 50 can integrally be formed by the materials described above, and in addition thereto, it can be provided with a structure in which a resin-made film having a liquid tightness or an outer coating member such as a cylinder and the like is integrally adhered around an outer periphery. The coating part 50 of the present embodiment is composed of a fiber bundle made of PET.

The resilient member 61 is suitably a coil spring made of stainless, and in addition thereto, a form and a material thereof do not matter even if it is a plate form or an elastomer as long as it can press the valve rod 62.

In the valve mechanism part 60, an outer peripheral part of the valve body 65 is interposed between a rear end part surface of the guide member 19 and a small-sized diameter reducing step part 63*a* at the front of the cylindrical support member 63, whereby the valve body 65 is fixed in an inside of the valve mechanism part 60. A rear part 52 of the coating part 50 having a smaller diameter than that of a front part 51 thereof is inserted into a central hole 65*a* of the valve body 65.

An aperture part is formed at the front part of the valve rod 62 and has a large diameter, and the rear part thereof is solid and formed in a small diameter. A small diameter part 53 at the rear part of the coating part 50 is inserted into the above aperture part 62*a* and tightly fixed. The valve mechanism part 60 has the cylindrical support member 63 in which the guide member 19 described above is fitted into an inside at a front side and in which a valve rod 62 and the resilient member 61 repelling the valve rod 62 toward the front are housed at the rear of the guide member 19, and a communication hole 64 allowing the reservoir 10 which is a filling tank for the liquid cosmetic to communicate with the valve rod 62 is formed at a rear end part of the above cylindrical support member 63.

To be detailed, the cylindrical support member 63 assumes roughly a container form which is closed generally in a wall shape at a rear part and which is opened at a front end part, and the small diameter part 53 at the rear part of the coating part 50 is mounted to a through hole 63*b* formed at a rear end part so that it can move freely forward and backward. Communication holes 64 of suitable size and number are formed on a side face part of the cylindrical support member 63.

The resilient member 61 is interposed between a step part on an outer peripheral surface of the aperture part 62*a* which is a front part of a large diameter in the valve rod 62, and a wall-shaped part at a rear end of the cylindrical support member 63, and it is provided in a position around the valve rod 62.

In this regard, the valve mechanism part 60 has a valve function in which a front end part of the valve rod 62 connected to the small diameter part 53 at a rear part of the coating part 50 comes into contact with and separates from the valve body 65 which comprises a rubber elastic body having a flexibility and which is in a position in front of the above valve rod 62, whereby the valve is opened and closed.

The valve body 65 is provided with a constitution in which an inner peripheral end part thereof brought into close contact with an outside surface of the coating part 50 in a pressed state and in which the above inner peripheral end part is deformed by movement of the coating part 50 while maintaining the close contact state to shut off an outside air flowing between an outside surface of the coating part 50 and the reservoir 10. The above flexible valve body 65 is provided with a structure in which it is fitted to a side surface of the coating part 50 and in which a rear end of the flexible valve body 65 is brought into contact with a front end of the above valve rod 62 by pressing the resilient member 61 comprising a coil spring to shut off the reservoir 10 from an outside.

The valve of the valve mechanism part 60 is opened by allowing the coating part 50 to go back by a coating pressure or a higher pressing pressure, and at the same time, the flexible valve body 65 fitted to the coating part 50 slides as well while deforming together with the coating part 50. When the valve comprising the valve body 65 and the valve rod 62 is opened by the above action, the liquid cosmetic is brought into contact with the coating part 50 to feed the liquid cosmetic 20, and the reservoir 10 is reduced temporarily in a pressure, so that air is about to come in from the outside. However, the flexible valve body 65 fitted to the coating part 50 prevents air from mixing in from the outside.

The cosmetic applicator B of the present embodiment constituted in the manner described above is prepared by providing the cylindrical reservoir 10, the coating part 50 composed of a fiber feed or a sintered feed which is mounted at a tip of the above cylindrical reservoir 10, the liquid cosmetic 20 charged directly to the above cylindrical reservoir 10 communicating with the coating part 50 via the valve mechanism part 60 which is an interposed member, and the liquid follower 25 which is brought into contact with the liquid cosmetic 20 and moves following a reduction in the liquid cosmetic 20 due to consumption thereof and which has a hue different from that of the liquid cosmetic 20, wherein a volume of the above follower is 0.5 or more based on a volume of the liquid cosmetic. The above constitution leads to providing the cosmetic applicator which is excellent in a stability in discharging the liquid cosmetic 20 and excellent as well in an aging stability of the liquid cosmetic 20 and which is excellent in a visibility of the reservoir 10 and the barrel 17 and further excellent in a visibility thereof by controlling a light transmittance thereof to 80% or more, so that the end of consuming the liquid cosmetic 20 is more easily distinguished.

The cosmetic applicators of the present invention shall not be restricted to the embodiments described above and can be varied in various manners and used as long as the scope of the present invention is not changed.

For example, the color of the follower was colorless in the embodiment described above, but if it is different from a hue of the liquid cosmetic and allowable in terms of a design, it may have another hue (black, red, blue, yellow or the like).

Also, the coating part mounted at a tip of the above cylindrical reservoir 10 was a ball holder in which a ball was held, a fiber bundle feed or a sintered feed, but it may be a brush type or elastomer type coating part.

EXAMPLES

Next, the present invention shall be explained in further details with reference to examples, but the present invention shall not be restricted by the examples and the like shown below.

Examples 1 to 2 and Comparative Examples 1 to 2

Liquid Cosmetics Used in Examples 1 to 2 and Comparative Examples 1 to 2

Components were mixed in the following blend composition and dispersed by means of a homomixer or a disper to prepare a manicure composition (nail liquid, whole amount: 100% by mass).

| Liquid cosmetic composition, color: white: | |
|---|---|
| Colorant: titanium oxide (CR-50, manufactured by Ishihara Sangyo Kaisha, Ltd.) | 55% by mass |
| Coating resin, dispersant: acrylic acid octyl amide/acrylic ester copolymer (AMPHOMER HC aqueous solution, manufactured by Aczo Nobel N.V.) | 10% by mass |

-continued

| Liquid cosmetic composition, color: white: | |
|---|---|
| Thickener: succinoglycan (RHEOZAN SH, manufactured by Solvay Nicca Co., Ltd.) | 26% by mass |
| Lubricant: phosphoric ester (C12 to 15) pales-9 phosphoric acid (Phosphanol RS-710, manufactured by Toho Chemical Industry Co., Ltd.) | 1% by mass |
| Wetting agent: ethylhexyl glycerin (Sensiva SC50JP, manufactured by Shulke & Mayr Gmbh) | 1% by mass |
| Defoaming agent: silicone base defoaming agent (KM-72, manufactured by Shin-Etsu Chemical Industry Co., Ltd.) | 1% by mass |
| Solvent: 1,3-butylene glycol | 0.3% by mass |
| Antiseptic agent: ethylparaben, methylparaben (manufactured by Midori Kagaku Co. , Ltd.) | 0.4% by mass |
| Refined water: | 5.3% by mass |

The viscosity value of the above composition was 500 to 3000 (m·Pa·s) according to measurement by means of a cone plate type viscometer at 25° C.

Liquid followers A and B (each whole amount: 100% by mass) were prepared in the following blend compositions.

| Composition of liquid follower A, color: colorless: | |
|---|---|
| Polybutene: 30N (manufactured by NOF Corporation) | 95.5% by mass |
| Olefin base thermoplastic elastomer Engage 8842 (manufactured by DuPont Dow Elastomers L.L.C.) | 4.5% by mass |

The liquid follower A had a specific gravity of about 40% based on a specific gravity of the liquid cosmetic described above.

| Composition of liquid follower B, color: black | |
|---|---|
| Mineral oil: Diana Process Oil PW-380 (manufactured by Idemitsu KOsan Co., Ltd.) | 93.5% by mass |
| Olefin base thermoplastic elastomer Milastomer 803N (manufactured by Mitsui Chemicals, Inc.) | 3.5% by mass |
| Oil-soluble dye: Oil Black 860 (manufactured by Orient Chemical Industries Co., Ltd.) | 3.0% by mass |

The liquid follower B had a specific gravity of about 40% based on a specific gravity of the liquid cosmetic described above.

The Liquid cosmetics and the liquid followers A and B each obtained above were used and charged into the cosmetic applicators shown in FIG. 1*a*, FIG. 1*b*, FIG. 2*a* and FIG. 2*b* and having the following constitution in a volume ratio shown in the following Table 1.

Coating ball 31: ϕ1 mm

Ballpoint pen tip 32: made of stainless steel

Reservoir 10: made of polypropylene, inner diameter: 4 mm, outer diameter: 6 mm, length: 96 mm, light transmittance: 80%

Barrel 17, front shaft 15: made of polypropylene, light transmittance: 80%

Rear shaft 16: made of ABS, light transmittance: 80%

The respective cosmetic applicators prepared in Examples 1 to 2 and Comparative Examples 1 to 2 were used to evaluate a coating property, an impact resistance, an aging stability and a coating property after aging by the following methods. The results thereof are shown in the following Table 1.

Evaluation Method of Coating Property on Nail:

The respective cosmetic applicators (n=2, hereinafter the same shall apply) obtained above were used to coat the liquid cosmetics on the nails of the respective fingers of both arms of expert panelists and evaluate the coating property on the nails according to the following evaluation criteria.

Evaluation Criteria of Coating Property on Nail:

◎: could evenly be coated by coating once

○: could evenly be coated by coating three times or less

Δ: could evenly be coated by coating ten times or less

X: could not evenly be coated even by coating ten times

Evaluation Method of Impact Resistance:

The respective cosmetic applicators obtained above were allowed to fall on a plastic-made plate from a height of 70 cm to evaluate the impact resistance according to the following evaluation criteria.

Evaluation Criteria:

◎: no abnormal matters observed

○: slight abnormal matter observed but no influence exerted on usability

Δ: abnormal matter observed to such extent as exerting influence on usability

X: not usable

Evaluation Method of Aging Stability:

The respective cosmetic applicators obtained above were left standing in the states of turning upward and turning downward under the environment of 50° C. to evaluate the state thereof after 1 month according to the following evaluation criteria.

Evaluation Criteria:

◎: no change observed

○: a little change on appearance observed but no influence exerted on usability

Δ: large change on appearance observed, and influence exerted on usability

X: not usable

Evaluation Criteria of Coating Property after Aging:

The respective cosmetic applicators obtained above were left standing in the states of turning upward and turning downward under the environment of 50° C. to evaluate the state thereof after 1 month according to the following evaluation criteria.

Evaluation Criteria:

◎: could evenly be coated by coating once

○: could evenly be coated by coating three times or less

Δ: could evenly be coated by coating ten times or less

X: could not evenly be coated even by coating ten times

TABLE 1

| | Example 1 | Example 2 | Comparative Example 1 | Comparative Example 1 |
|---|---|---|---|---|
| Volume ratio of the liquid follower | 0.63 | 1.0 | 0.2 | 0.05 |
| Coating property | ◎ | ◎ | X | X |
| Impact resistance | ◎ | ◎ | Δ | X |
| Aging stability | ◎ | ◎ | ○ | Δ |
| Coating property after aging | ◎ | ○ | X | X |

As apparent from the results shown in Table 1 described above, it could be confirmed that the cosmetic applicators prepared in Examples 1 to 2 according to the present invention are excellent in a coating property on a nail, an impact resistance, an aging stability and a coating property after aging as compared with the cosmetic applicators prepared in Comparative Examples 1 to 2 falling outside the present invention.

What is claimed is:

1. A cosmetic applicator comprising:

a cylindrical reservoir, a coating part mounted at a tip of a housing of the cylindrical reservoir, a liquid cosmetic supplied directly to at least partially fill the cylindrical reservoir to the coating part or directly to the cylindrical reservoir communicating with the coating part via an interposed member to at least partially fill the cylindrical reservoir, and a liquid follower which is brought into contact with the liquid cosmetic and moves following a reduction in the liquid cosmetic due to consumption thereof and which has a hue different from that of the liquid cosmetic, wherein a volume of the follower is 0.5 or more based on a maximum volume of the liquid cosmetic of the cylindrical reservoir, and wherein the liquid follower comprises at least one selected from a liquid which is insoluble or scarcely soluble in the liquid cosmetic, comprising a nonvolatile or scarcely volatile organic solvent, a gelled substance of the insoluble or scarcely soluble liquid comprising a liquid containing the nonvolatile or scarcely volatile organic solvent and a thickener.

2. The cosmetic applicator as described in claim 1, wherein the nonvolatile or scarcely volatile organic solvent is at least one selected from polybutene, mineral oils, silicone oils, liquid paraffins, and poly-α-olefins.

3. The cosmetic applicator as described in claim 1, wherein the thickener is at least one selected from styrene base thermoplastic elastomers, vinyl chloride base thermoplastic elastomers, olefin base thermoplastic elastomers, polyamide base thermoplastic elastomers, polyester base thermoplastic elastomers, polyurethane base thermoplastic elastomers, calcium salts of phosphoric acid esters, fine particle silica, and acetoalkoxyaluminum dialkylates.

4. The cosmetic applicator as described in claim 1, wherein the follower has a specific gravity of less than 100% of a specific gravity of the liquid cosmetic.

5. The cosmetic applicator as described in claim 1, wherein the cylindrical reservoir is formed by a material having a light transmittance of 50% or more.

6. The cosmetic applicator as described in claim 1, wherein the coating part is a ball holder which holds a ball.

7. The cosmetic applicator as described in claim 6, wherein the ball holder is constituted by metal.

8. The cosmetic applicator as described in claim 1, wherein the coating part is a fiber bundle feed.

9. The cosmetic applicator as described in claim 1, wherein the coating part is a sintered feed.

10. The cosmetic applicator as described in claim 1, wherein an inner wall surface of the cylindrical reservoir is subjected to a water repellent film forming treatment by coating with a water repellent agent of a silicone base, a silicon resin or a fluorine base.

* * * * *